US008764482B2

(12) United States Patent
Matsumura et al.

(10) Patent No.: US 8,764,482 B2
(45) Date of Patent: Jul. 1, 2014

(54) FEMALE-TYPE METAL TERMINAL FITTING

(71) Applicant: Yazaki Corporation, Tokyo (JP)

(72) Inventors: Kaoru Matsumura, Shizuoka (JP); Tomoyoshi Fukaya, Shizuoka (JP); Kenji Kajikawa, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/852,842

(22) Filed: Mar. 28, 2013

(65) Prior Publication Data

US 2013/0224983 A1 Aug. 29, 2013

Related U.S. Application Data

(63) Continuation of application No. PCT/JP2011/073979, filed on Oct. 12, 2011.

(30) Foreign Application Priority Data

Oct. 12, 2010 (JP) ..... 2010-229955

(51) Int. Cl.

| | |
|---|---|
| ***H01R 13/40*** | (2006.01) |
| ***H01R 13/422*** | (2006.01) |
| ***H01R 13/11*** | (2006.01) |
| ***H01R 13/627*** | (2006.01) |

(52) U.S. Cl.

CPC ..... *H01R 13/4223* (2013.01); *H01R 13/113* (2013.01); *H01R 13/6272* (2013.01)

USPC ..... 439/595

(58) Field of Classification Search

USPC ..... 439/345, 595, 748, 842, 851, 852, 871

See application file for complete search history.

(56) References Cited

U.S. PATENT DOCUMENTS

| | | | | |
|---|---|---|---|---|
| 5,151,052 | A * | 9/1992 | McCardell | 439/598 |
| 5,860,836 | A | 1/1999 | Ohno | |
| 6,305,992 | B1 | 10/2001 | Bouda et al. | |

(Continued)

FOREIGN PATENT DOCUMENTS

| | | | |
|---|---|---|---|
| EP | 1 587 171 | A1 | 10/2005 |
| JP | 2008-41315 | A | 2/2008 |
| WO | 98/18181 | A1 | 4/1998 |

OTHER PUBLICATIONS

International Search Report for PCT/JP2011/073979 and Form PCT/ISA/237 dated Mar. 15, 2012.

*Primary Examiner* — Neil Abrams
*Assistant Examiner* — Travis Chambers
(74) *Attorney, Agent, or Firm* — Kenealy Vaidya LLP

(57) ABSTRACT

A connector provided with a female-type metal terminal fitting, includes a case portion including a bottom plate portion, first and second side plate portions, and an upper plate portion, a lance engaging portion formed at a rear end portion of the upper plate portion so as to engage with a lance, a biasing portion integrated in the case portion, a wire connecting portion provided so as to be extended to a rear side of the case portion, and a spring supporting plate portion laminated on an inner face of the upper plate portion. A rear end portion of the spring supporting plate portion is recessed toward inside of the case portion further than the rear end portion of the upper plate portion. The biasing portion is extended from the spring supporting plate portion.

6 Claims, 9 Drawing Sheets

(56) References Cited

U.S. PATENT DOCUMENTS 6,679,738 B2 * 1/2004 Nimura ..... 439/852
7,048,582 B2 * 5/2006 Tabata et al. ..... 439/595
8,388,388 B2 * 3/2013 Suzuki et al. ..... 439/752.5
2002/0077000 A1 * 6/2002 Nimura ..... 439/852
2005/0227551 A1 10/2005 Tabata et al.

* cited by examiner

FEMALE-TYPE METAL TERMINAL FITTING

CROSS REFERENCE TO RELATED APPLICATION

This application is a continuation of PCT application No. PCT/JP2011/073979, which was filed on Oct. 12, 2011 based on Japanese Patent Application (No. P2010-229955) filed on Oct. 12, 2010, the contents of which are incorporated herein by reference. Also, all the references cited herein are incorporated as a whole.

BACKGROUND

1. Technical Field

The present invention relates to a female-type metal terminal fitting that is prevented from slipping out by a lance provided on an inner face of a connector housing when the female-type metal terminal fitting is attached to a terminal-receiving hole of the connector housing.

2. Background Art

FIGS. 8 and 9 illustrate an example of a female-type metal terminal fitting that is prevented from slipping out by a lance provided on an inner face of a connector housing in a related art when the female-type metal terminal fitting is attached in a terminal-receiving hole of a connector housing.

This female-type metal terminal fitting is disclosed in JP-A-2008-41315.

The female-type metal terminal fitting 101 is a metal terminal fitting that is formed by press forming a metal plate and, as shown in FIG. 8, includes a case portion 110, a lance engaging portion 120, a biasing portion 130 and a wire connecting portion 140.

As shown in FIG. 9, the case portion 110 is a portion in which a tab 210 of a male-type metal terminal fitting is inserted.

The case portion 110 has an angular tube shape including a bottom plate portion 111, both side plate portions 112 that rise up from both side edges of the bottom plate portion 111, and a ceiling plate portion 115 that is extended from an upper end edge of one side plate portion 112 so as to connect the upper ends of the both side plate portions 112, and is formed by folding a sheet of a metal plate.

In the case as shown in FIGS. 8 and 9, a front plate portion 116 that covers a front side of the angular case is formed by folding at the front end of the ceiling plate portion 115. Thus, as shown in FIG. 9, a tab inserting portion 117 for inserting a tab 210 is formed at a lower end of the front plate portion 116.

The lance engaging portion 120 is a portion where a lance 221 in the connector housing is engaged at a rear end portion of the ceiling plate portion 115 of the case portion 110.

The biasing portion 130 is a plate spring that presses the tab 210 of the male-type metal terminal fitting that is inserted in the case portion 110 to the bottom plate portion 111 so as to maintain the tab 210 in a contacted state with the bottom plate portion 111.

The biasing portion 130 is the plate spring that is provided as extending inclined to the front end side of the bottom plate portion 111 from the rear end of the ceiling plate portion 115. The front end side of the biasing portion 130 is folded in an upper direction and a front end portion 131 that is a free end is made to contact the inside surface of the ceiling plate portion 115.

A wire connecting portion 140 is a portion where wires are press-contacted, and is formed to extend to a rear side of the case portion 110. As shown in FIG. 8, the wire connecting portion 140 includes a sheath fixing piece 141 that is clamped to a sheath portion of the sheathed wire and a wire pressing piece 142 that is clamped to a conductive portion of the sheathed wire.

However, in the female-type metal terminal fitting 101 that is prevented from slipping out by the lance provided on the inner face of the connector housing, when a tension force (a force in a direction of the arrow T1 in FIG. 9) affects the wire connecting portion 140 from the wire that is connected to the wire connecting portion 140, a compression load P1 affects the lance engaging portion 120 from the lance 221 provided in the connector housing as a reaction.

Thus, in the female-type metal terminal fitting 101 disclosed in JP-A-2008-41315, since the biasing portion 130 is extended from the rear end of the ceiling plate portion 115 that is set as the lance engaging portion 120, there is a concern that the biasing portion 130 may be deformed accordingly and the pressing force to the tab 210 from the biasing portion 130 may be varied when the lance engaging portion 120 is bent by the compression load P1.

The variation of the pressing force of the biasing portion 130 to the tab 210 causes decreasing of connecting characteristics between the metal terminal fittings due to the variation of the contact pressure between the metal terminal fittings.

SUMMARY

Accordingly, the object of the invention is to solve the problems and even in a case where the above-described compression load affects the lance engaging portion from the lance in the connector housing, the compression load does not cause variation of the terminal biasing plate spring and the terminal biasing plate spring maintains a stable pressing force. Thus, the female-type metal terminal fitting is provided wherein reliability of the connection between the metal terminal fittings may be enhanced.

The above-described object of the invention is achieved by the below-described configurations.

(1) There is provided a connector provided with a female-type metal terminal fitting, the connector comprising:

a case portion that includes a bottom plate portion, first and second side plate portions which rise up from both side edges of the bottom plate portion, and an upper plate portion which connects upper ends of the first and second side plate portions, and is adapted to receive a male-type metal terminal fitting;

a connector housing that has a terminal receiving hole which is configured to receive the case portion therein;

a lance engaging portion that is formed at a rear end portion of the upper plate portion of the case portion so as to engage with a lance, the lance being protruded toward inner space of the terminal receiving hole from an inner face of the terminal receiving hole of the connector housing and being extending to a front direction;

a biasing portion that is integrated in the case portion so as to press the male-type metal terminal fitting received in the case portion to the bottom plate portion so that the male-type metal terminal fitting is maintained in a contacted state with the bottom plate portion;

a wire connecting portion that is provided so as to be extended to a rear side of the case portion; and a spring supporting plate portion that is arranged so as to be laminated on an inner face of the upper plate portion, wherein a rear end portion of the spring supporting plate portion is recessed toward inside of the case portion further than the rear end portion of the upper plate portion along an extending direction of the spring supporting plate portion; and wherein the biasing portion is extended from the spring supporting plate portion toward a front end side of the bottom plate portion.

(2) Preferably, the bottom plate portion, the first and second side plate portions, and the upper plate portion are formed by a single sheet of a metal plate.

(3) Preferably, the lance engaging portion is spatially separated from the rear end portion of the spring supporting plate portion.

(4) Preferably, the upper plate portion is integrated in an upper edge of first side plate portion, and the spring supporting plate portion is integrated in an upper edge of the second side plate portion.

(5) Preferably, the biasing portion is a plate spring.

DETAILED DESCRIPTION OF THE EXEMPLARY EMBODIMENTS

Hereinbelow, preferred embodiment of the female-type metal terminal fitting according to the invention will be described with reference to drawings.

Figure 1:
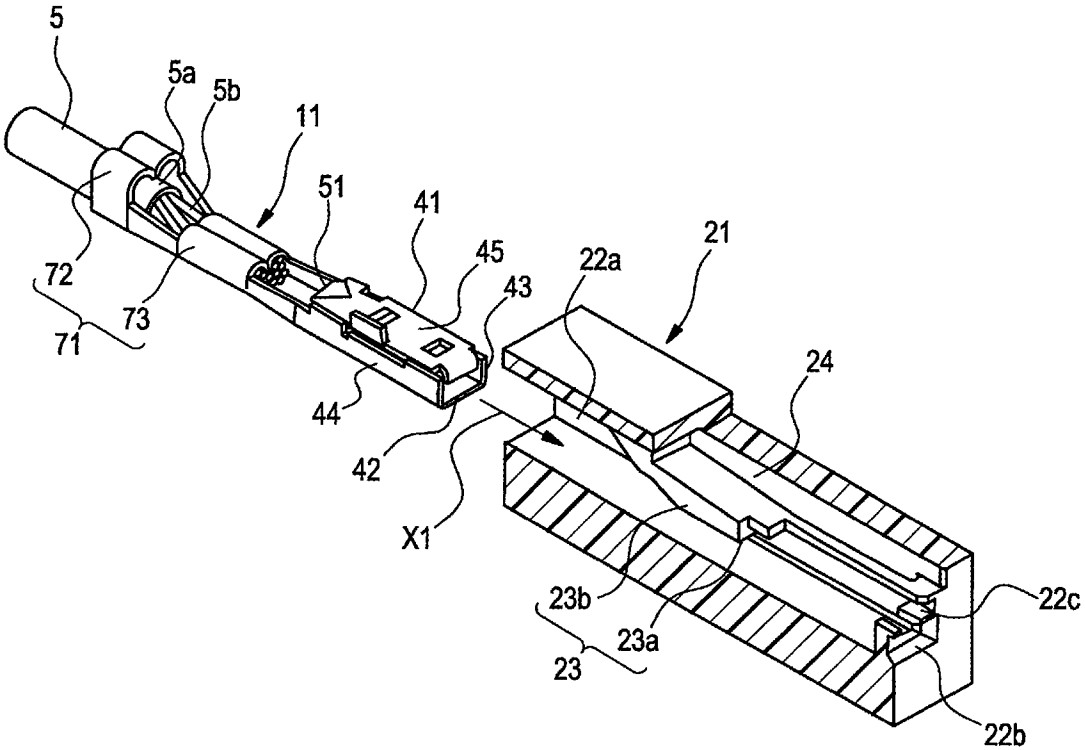
FIG. 1 is an exploded perspective view of an embodiment of a female-type metal terminal fitting and a connector housing according to the invention.
Figure 2A:
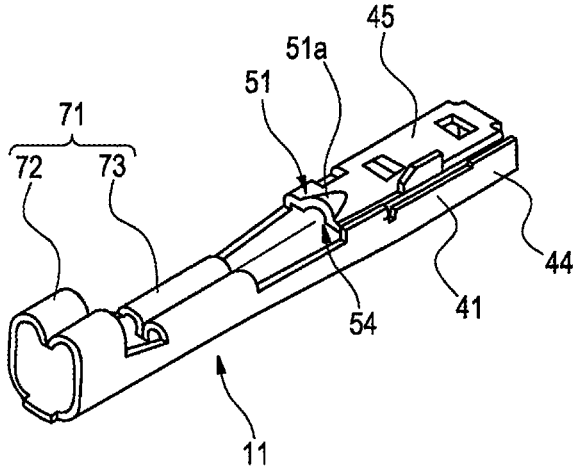
FIG. 2A is an external perspective view of the female-type metal terminal fitting shown in FIG. 1.
Figure 2B:
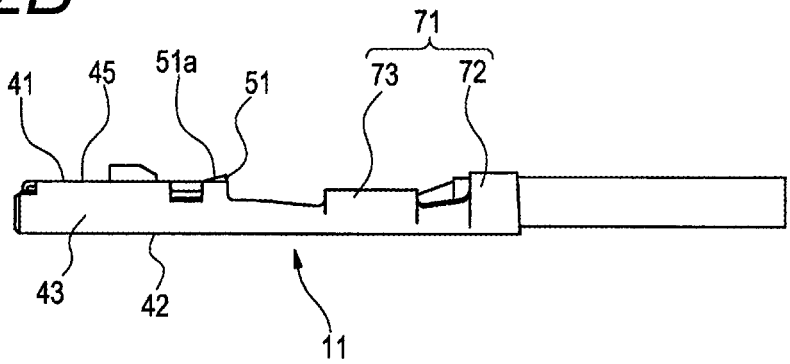
FIG. 2B is a side view of the female-type metal terminal fitting shown in FIG. 1
Figure 2C:
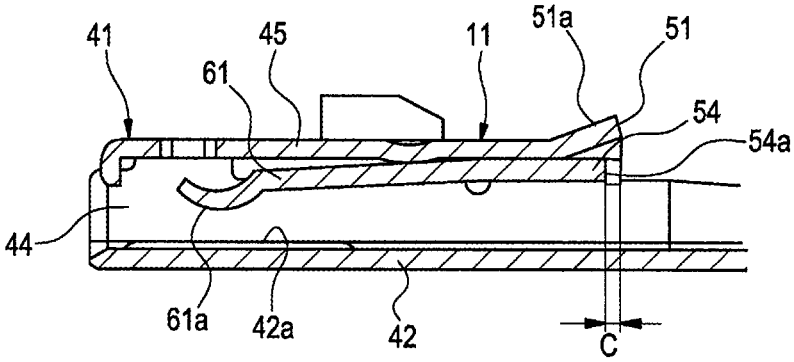
FIG. 2C is a vertical cross-sectional view of the female-type metal terminal fitting shown in FIG. 1.

FIGS. 1 to 2C illustrate an embodiment of a female-type metal terminal fitting according to the invention. FIG. 1 is an exploded perspective view of a female-type metal terminal fitting and a connector housing according to the embodiment of the invention. FIG. 2A is an external perspective view of the female-type metal terminal fitting shown in FIG. 1. FIG. 2B is a side view of the female-type metal terminal fitting shown in FIG. 1. FIG. 2C is a vertical sectional view of the female-type metal terminal fitting shown in FIG. 1.

A lance 23 provided an inner face of a connector housing 21 prevents the female-type metal terminal fitting 11 from slipping out when the female-type metal terminal fitting 11 is attached in a terminal-receiving hole 22 of the connector housing 21.

As shown in FIGS. 1 to 2C, the female-type metal terminal fitting 11 includes a case portion 41, a lance engaging portion 51, a spring supporting plate portion 54, a terminal biasing plate spring 61 and a wire connecting portion 71.

Figure 3:
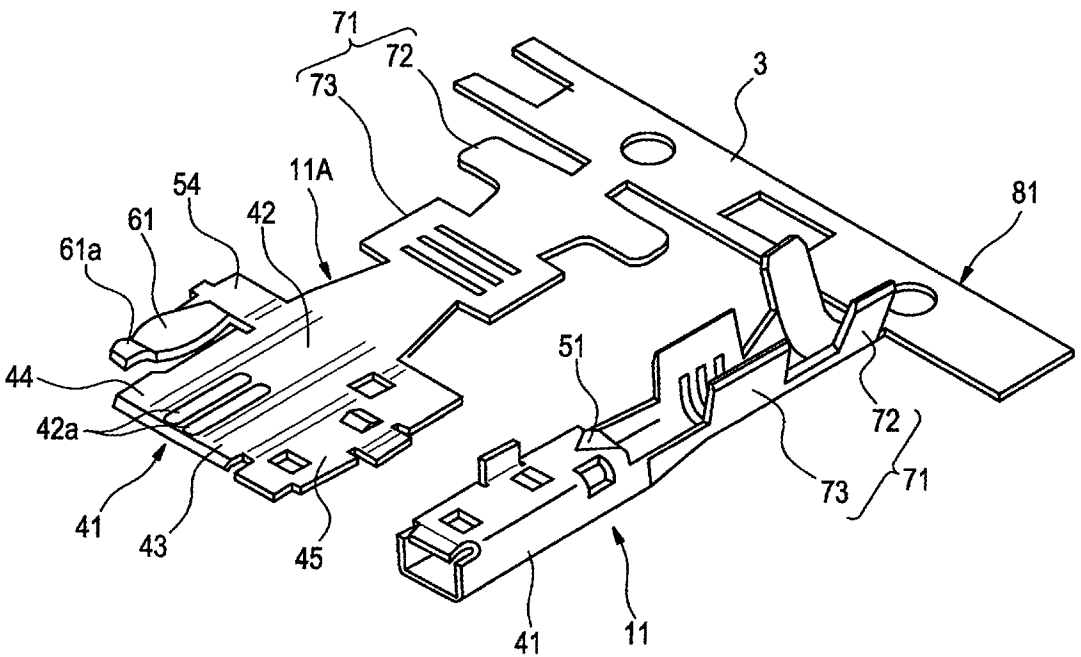
FIG. 3 is a perspective view illustrating a taking out of a plate of the female-type metal terminal fitting shown in FIG. 1 when performing press processing.
Figure 4:
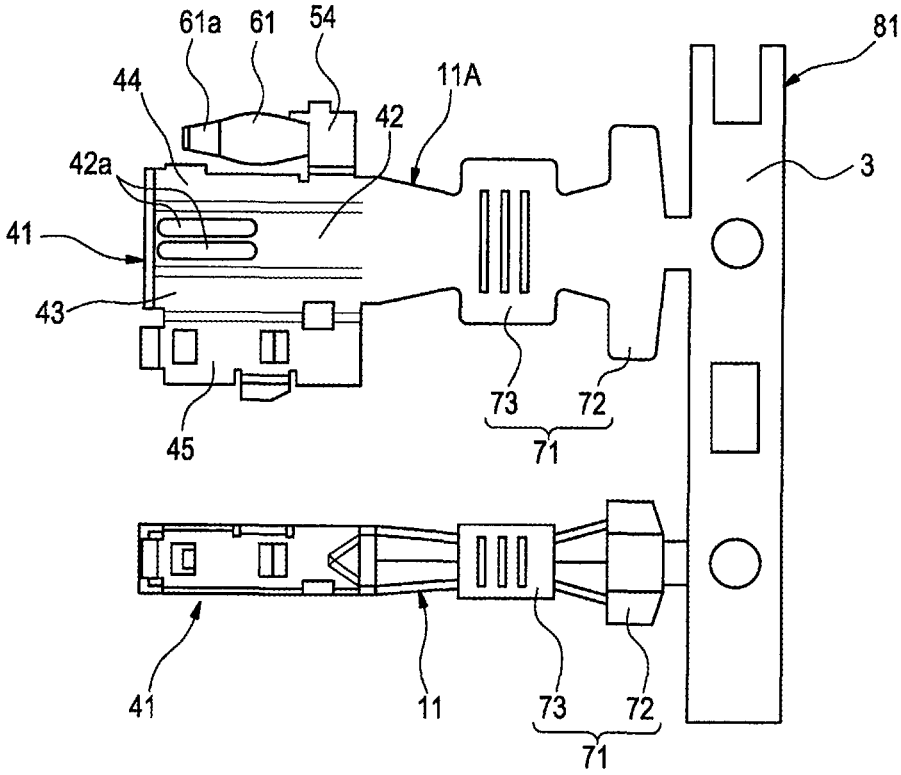
FIG. 4 is a plan view illustrating taking of a plate of the female-type metal terminal fitting shown in FIG. 1 when performing press processing.

As shown in FIGS. 3 and 4, the female-type metal terminal fitting 11 is formed by folding a single sheet of a metal plate 81. In FIGS. 3 and 4, a reference number 11A indicates an unfolded shape of the female-type metal terminal fitting 11 before press forming, and a reference number 3 indicates a connecting portion that connects the unfolded shapes 11A of the female-type metal terminal fittings 11 at a constant interval. The connecting portion 3 is used for transportation when the press forming is performed and it is cut and separated from the female-type metal terminal fitting 11 after the press forming. In the unfolded shape 11A of the female-type metal terminal fitting 11 shown in FIGS. 3 and 4, the same reference numbers are appended to the same portions after folding and molding, and conformity with the shape after folding and molding is shown.

Next, the configuration of each portion of the female-type metal terminal fitting 11 will be described in detail.

The case portion 41 is a portion in which the male-type metal terminal fitting is inserted and is formed in an angular case shape including a bottom plate portion 42, both side wall portions 43 and 44 that rise up from both side edges of the bottom plate portion 42, and a ceiling plate portion 45 that connects upper ends of both side wall portions.

A contacting portion 42*a* for contacting a male-type metal terminal fitting is formed at the bottom plate portion 42 so as to protrude from the bottom plate portion 42. As shown in FIGS. 3 and 4, the contacting portion 42*a* is formed so as to extend in an inserting direction of the male-type metal terminal fitting.

The ceiling plate portion 45 is formed by folding a portion that is connected to the upper edge of one of the sidewall portions 43 and 44 with respect to the sidewall portion 43 in a right angle.

The lance engaging portion 51 is formed at a rear portion of the ceiling plate portion 45.

As shown in FIG. 2C, the lance engaging portion 51 has a curved portion 51*a* that is convex to the upper side at a portion where the lance 23 in the connector housing 21 is engaged so that the stiffness thereof is enhanced.

The spring supporting plate portion 54 is formed by folding in a right angle a portion that is connected to the upper edge of the rear end side of the other of the sidewall portions 43 and 44.

As shown in FIG. 2C, the spring supporting plate portion 54 is arranged at a portion where a rear end portion 54*a* of the spring supporting plate portion 54 is recessed from (further inside than) the rear end portion of the ceiling plate portion 45 (the rear end portion of the lance engaging portion 51) by a distance C.

The terminal biasing plate spring 61 is integrally formed with the spring supporting plate portion 54 that is one of the plate portions for forming the case portion 41 to maintain the male-type metal terminal fitting inserted into the case portion 41 in a state where the male-type metal terminal fitting is pressed to the bottom plate portion 42.

As shown in FIG. 2C, the terminal biasing plate spring 61 is formed so as to extend from the spring supporting plate portion 54 to the front end side of the bottom plate portion 42. A front end 61*a* of the terminal biasing plate spring 61 is arranged at a position opposed to the contacting portion 42*a* of the bottom plate portion 42 and closely contacts the male-type metal terminal fitting to the contacting portion 42*a*.

The front end 61*a* of the terminal biasing plate spring 61 is formed in a convex curved shape to the lower side so that the inserted male-type metal terminal fitting is not caught and the sliding resistance with the male-type metal terminal fitting is small.

The wire connecting portion 71 is formed so as to extend toward the rear side of the case portion 41 at a position where a wire is press-contacted. As shown in FIG. 1, the wire connecting portion 71 include a sheath fixing piece 72 that is clamped to a sheath portion 5*a* of the sheathed wire 5 and a wire pressing piece 73 that is clamped to a conductive portion 5*b* of the sheathed wire 5.

Figure 5B:
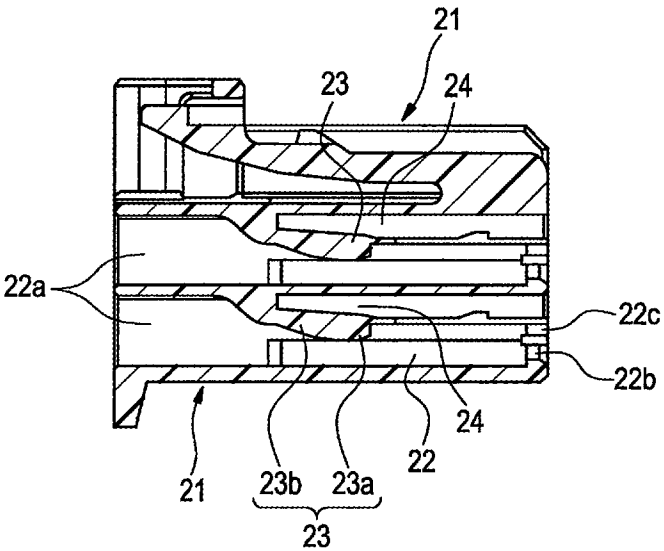
FIG. 5B is a cross-sectional view taken along line A-A in FIG. 5A.

Next, a configuration of the connector housing 21 to which the female-type metal terminal fitting 11 is attached will be described with reference to FIGS. 5 to 7.

Figure 5A:
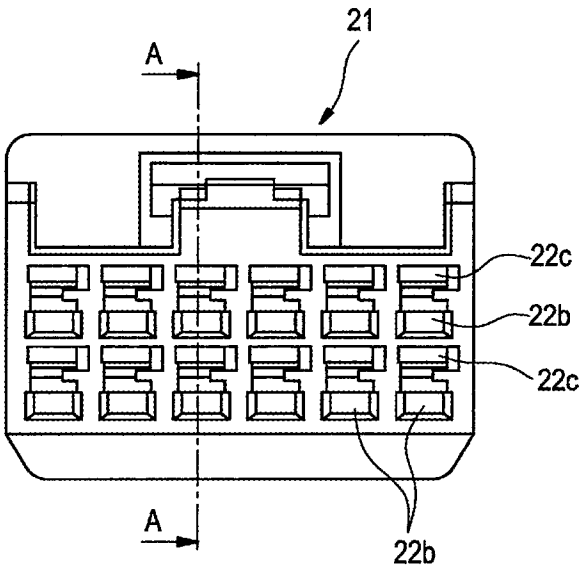
FIG. 5A is a front view of the connector housing shown in FIG. 1
Figure 6:
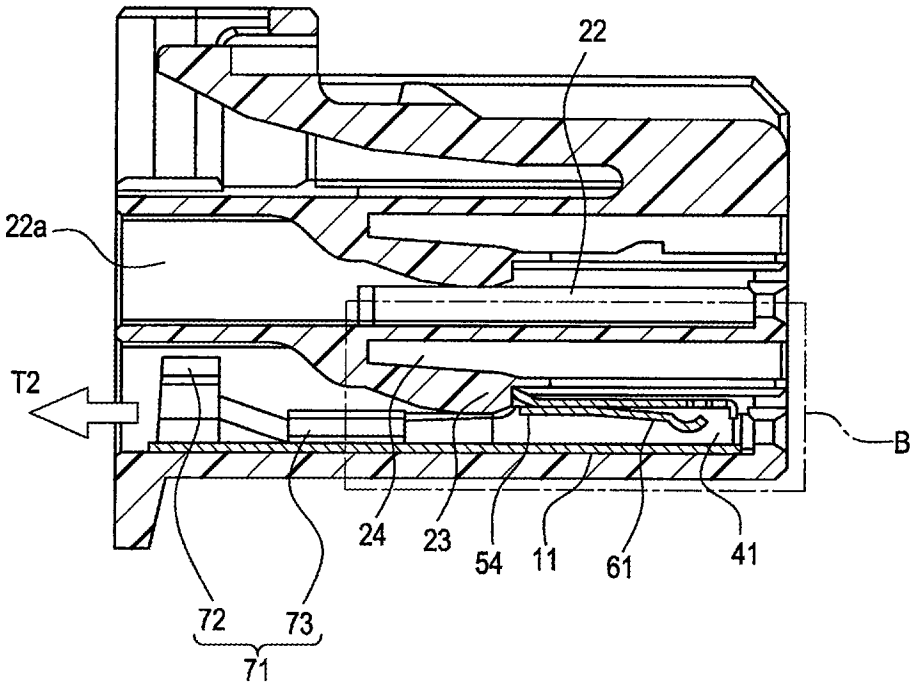
FIG. 6 is a vertical sectional view of a state where the female-type metal terminal fitting shown in FIG. 1 is installed in the connector housing.

FIG. 5A is a front view of the connector housing 21 shown in FIG. 1. FIG. 5B is a cross-sectional view taken along a line A-A in FIG. 5A. FIG. 6 is a vertical sectional view of a state where the female-type metal terminal fitting shown in FIG. 1 is installed in the connector housing 21. FIG. 7 is an enlarged view of a portion B in FIG. 6.

The connector housing 21 includes the terminal-receiving hole 22 in which the female-type metal terminal fitting 11 is inserted, the lance 23 and a lance bending space 24.

As shown in FIGS. 5A and 5B, in a case of the connector housing 21 of the embodiment, the terminal-receiving hole 22 is arranged in two columns in the longitudinal direction and six lines in the lateral direction. In addition, a rear end side 22*a* of the terminal-receiving hole 22 that is opened to a rear end (a base end) of the connector housing 21 is an insertion port of the female-type metal terminal fitting 11 so that the port thereof is opened wider than that of the front end side.

Furthermore, a terminal inserting port 22*b* in which the front end portion of the male-type metal terminal fitting (not shown) is inserted and a conductive pin inserting port 22*c* in which a conductive pin of a jig for detecting a semi-insertion (not shown) is passed are formed at the front end portion of the terminal-receiving hole 22.

The lance 23 includes an engaging projection 23*a* and a elastic piece 23*b*. The elastic piece 23*b* is extended along the inserting direction (an arrow direction X1 in FIG. 1) of the female-type metal terminal fitting 11 from the base end side of the connector housing 21. The engaging projection 23*a* is projected toward the front end side of the elastic piece 23*b* so as to project to the terminal-receiving hole 22.

The lance 23 is flexibly displaced to the lance flexing space 24 and allows the female-type metal terminal fitting 11 to be inserted so that the engaging protrusion 23*a* escapes outside the terminal-receiving hole 22 according to the insertion of the female-type metal terminal fitting 11 into the terminal-receiving hole 22. Thus, as shown in FIGS. 6 and 7, when the female-type metal terminal fitting 11 is inserted into a normal position, the engaging protrusion 23*a* engages the lance engaging portion 51 and the flexed displacement is restored so that the female-type metal terminal fitting 11 is in a slip prevention state by the engaging protrusion 23*a*.

The engaging protrusion 23*a* engages the lance engaging portion 51 at the rear end of the case portion 41 of the female-type metal terminal fitting 11 so that the female-type metal terminal fitting 11 does not slip out.

The lance flexing spaces 24 are formed in parallel state to the outside of the terminal-receiving hole 22 so that the flexed displacement of the lance 23 is allowed according to the insertion of the female-type metal terminal fitting 11.

Figure 7:
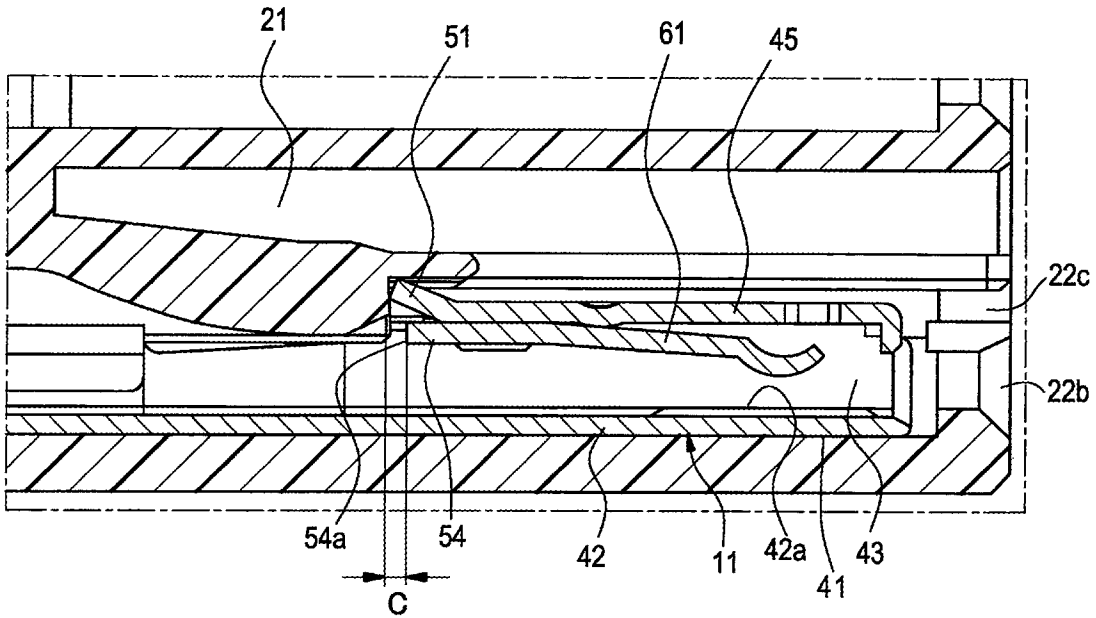
FIG. 7 is an enlarged view of B portion in FIG. 6.
Figure 8:
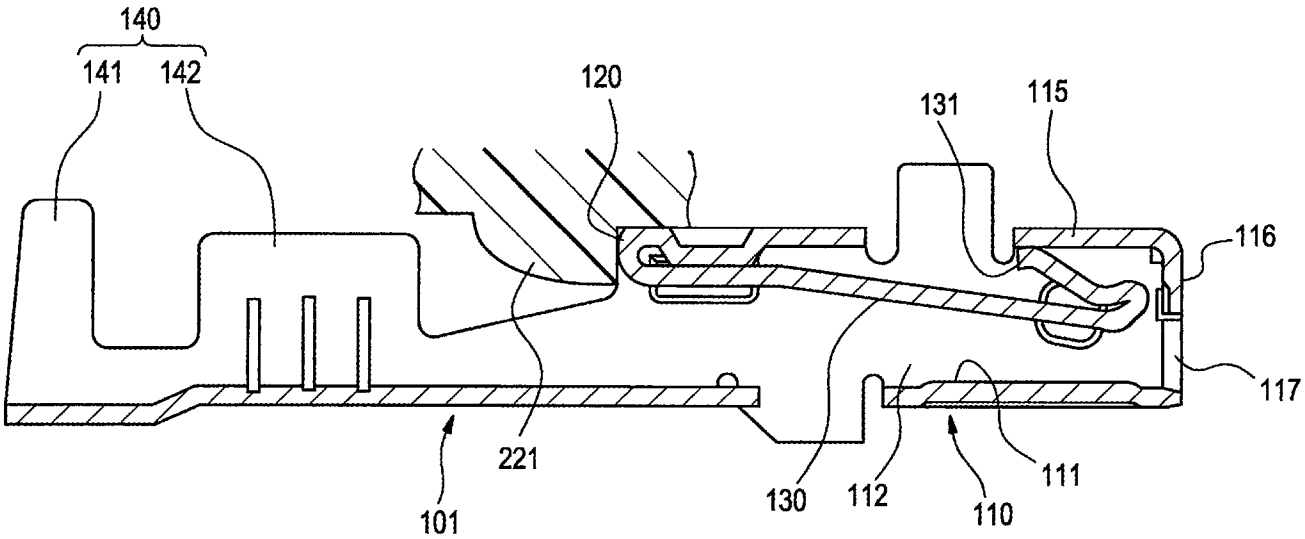
FIG. 8 is a vertical sectional view of a female-type metal terminal fitting of the related art.
Figure 9:
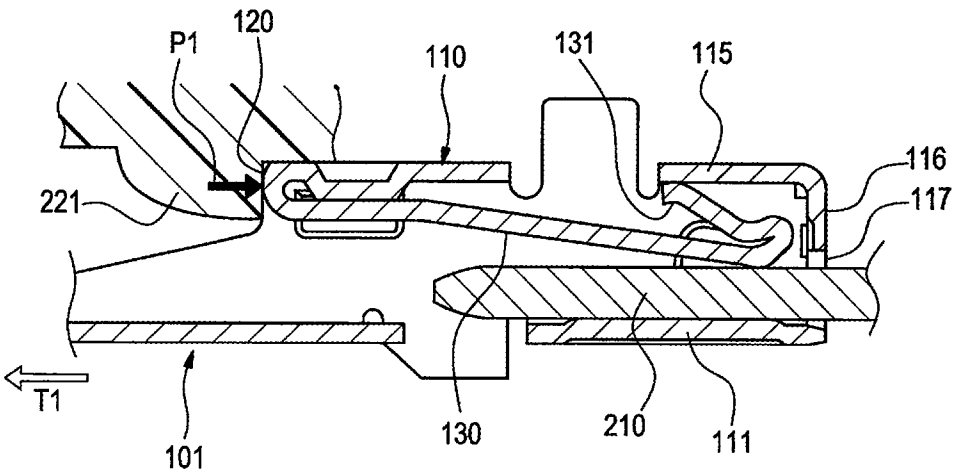
FIG. 9 is a vertical sectional view of a state where a male-type metal terminal fitting engages the female-type metal terminal fitting shown in FIG. 8.

In the case of the female-type metal terminal fitting 11 of the embodiment, as shown in FIG. 7, the terminal biasing plate spring 61 is extended from the spring supporting plate portion 54 that is separated from the ceiling plate portion 45. Furthermore, the rear end of the spring supporting plate portion 54 is arranged further inside than the rear end portion of the ceiling plate portion 45 where the lance engaging portion 51 is formed by the distance C so that the spring supporting plate portion 54 having the terminal biasing plate spring 61 is maintained in a non-contact state with the lance 23 even though the female-type metal terminal fitting 11 is prevented from slipping out by the lance 23 of the connector housing 21.

Accordingly, even in a case where a compression load affects the lance engaging portion 51 from the lance 23 in the connector housing 21 with a tension force T2 or the like (see FIG. 6), the terminal biasing plate spring 61 may stably maintain the pressing force, and the reliability of the connection between the metal terminal fittings may be enhanced, without the compression load causing deformation of the terminal biasing plate spring 61. The tension force T2 or the like affects the wire connecting portion 71 from the sheathed wire 5 (see FIG. 1) that is connected to the wire connecting portion 71.

According to the above disclosure, the biasing portion is extended from the spring supporting plate portion that is separated from the upper plate portion. Furthermore, the rear end of the spring supporting plate portion is arranged further inside than the rear end portion of the upper plate portion where the lance engaging portion is formed, so that the spring supporting plate portion where the biasing portion is formed is maintained in a non-contact state with the lance even in a state where the female-type metal terminal fitting is prevented from slipping out by the lance of the connector housing.

Accordingly, even in a case where a compression load affects the lance engaging portion from the lance provided in the connector housing with a tension force or the like that affects the wire connecting portion from a wire that is connected to the wire connecting portion, the compression load does not cause deformation of the biasing portion and the biasing portion stably maintains the pressing force so that the reliability of the connection between metal terminal fittings may be enhanced.

According to the above disclosure, the spring supporting plate portion is maintained in a non-contact state with the lance. Accordingly, even in a case where the compression load affects the lance engaging portion from the lance inside the connector housing with the tension force or the like that affects the wire connecting portion from a wire that is connected to the wire connecting portion, the compression load does not cause the deformation of the biasing portion and the biasing portion stably maintains the pressing force so that the reliability of the connection between metal terminal fittings may be enhanced.

In addition, the invention is not limited to the above-described embodiment and suitable modifications, improvements or the like may be made. Also, the material, shape, dimensions, number, installation places or the like of each configuration element in the above-described embodiment are not specifically limited as long as the object of the invention may be achieved.

A female-type metal terminal fitting in which reliability of the connection between the metal terminal fittings may be enhanced can be provided.

What is claimed is:

1. A connector provided with a female-type metal terminal fitting, the connector comprising:

a case portion that includes a bottom plate portion, first and second side plate portions which rise up from both side edges of the bottom plate portion, and an upper plate portion which connects upper ends of the first and second side plate portions, and is adapted to receive a male-type metal terminal fitting;

a connector housing that has a terminal receiving hole which is configured to receive the case portion therein;

a lance engaging portion that is formed at a rear end portion of the upper plate portion of the case portion so as to engage with a lance, the lance being protruded toward inner space of the terminal receiving hole from an inner face of the terminal receiving hole of the connector housing and being extending to a front direction;

a biasing portion that is integrated in the case portion so as to press the male-type metal terminal fitting received in the case portion to the bottom plate portion so that the male-type metal terminal fitting is maintained in a contacted state with the bottom plate portion;

a wire connecting portion that is provided so as to be extended to a rear side of the case portion; and a spring supporting plate portion that is arranged so as to be laminated on an inner face of the upper plate portion, wherein a rear end portion of the spring supporting plate portion is recessed toward inside of the case portion further than the rear end portion of the upper plate portion along an extending direction of the spring supporting plate portion;

wherein the biasing portion is extended from the spring supporting plate portion toward a front end side of the bottom plate portion;

wherein the lance is spatially separated from the rear end portion of the spring supporting plate portion; and wherein the lance is integrally formed with the connector housing.

2. The connector according to claim 1, wherein the bottom plate portion, the first and second side plate portions, and the upper plate portion are formed by a single sheet of a metal plate.

3. The connector according to claim 1, wherein the lance engaging portion is spatially separated from the rear end portion of the spring supporting plate portion.

4. The connector according to claim 1, wherein the upper plate portion is integrated in an upper edge of first side plate portion; and wherein the spring supporting plate portion is integrated in an upper edge of the second side plate portion.

5. The connector according to claim 1, wherein the biasing portion is a plate spring.

6. The connector according to claim 1, wherein the curved portion of the upper plate portion extends in a first substantially linear direction from the rear end portion of the upper plate portion towards the spring supporting plate portion and forms an acute angle with respect to the spring supporting plate portion.

* * * * *